United States Patent [19]

Zedrosser et al.

[11] Patent Number: 4,745,843

[45] Date of Patent: May 24, 1988

[54] TRIGGER DEVICE FOR AUTOMATIC HANDGUNS

[75] Inventors: Ulrich Zedrosser; Walter Rossak, both of Steyr, Austria

[73] Assignee: Steyr-Daimler-Puch AG, Vienna, Austria

[21] Appl. No.: 870,719

[22] Filed: Jun. 4, 1986

[30] Foreign Application Priority Data

Jun. 7, 1985 [AT] Austria ..... 1713/85

[51] Int. Cl.[4] ..... F41D 11/02

[52] U.S. Cl. ..... 89/132; 89/198

[58] Field of Search ..... 42/69.02; 89/132, 198

[56] References Cited

FOREIGN PATENT DOCUMENTS 506922 9/1930 Fed. Rep. of Germany ..... 42/69.02
1428788 1/1970 Fed. Rep. of Germany .
2511765 9/1976 Fed. Rep. of Germany .
419907 3/1967 Switzerland .
419906 3/1967 Switzerland .

*Primary Examiner*—Stephen C. Bentley
*Attorney, Agent, or Firm*—Marmorek, Guttman & Rubenstein

[57] ABSTRACT

A trigger mechanism for automatic hand firearms with a catching lever is disclosed. The catching lever bears at its forward end a catching pawl which comprises a double-arm rocking lever. The forward arm of the lever is supported against the force of a lock spring by a spring-suspended abutment, while an expanding pressure spring is located between the rearward lever arm of the rocking lever and the catching lever. This arrangement achieves a favorable distribution of forces on discharge of the firearm, so that the catching elements can be produced from lightweight materials.

3 Claims, 1 Drawing Sheet

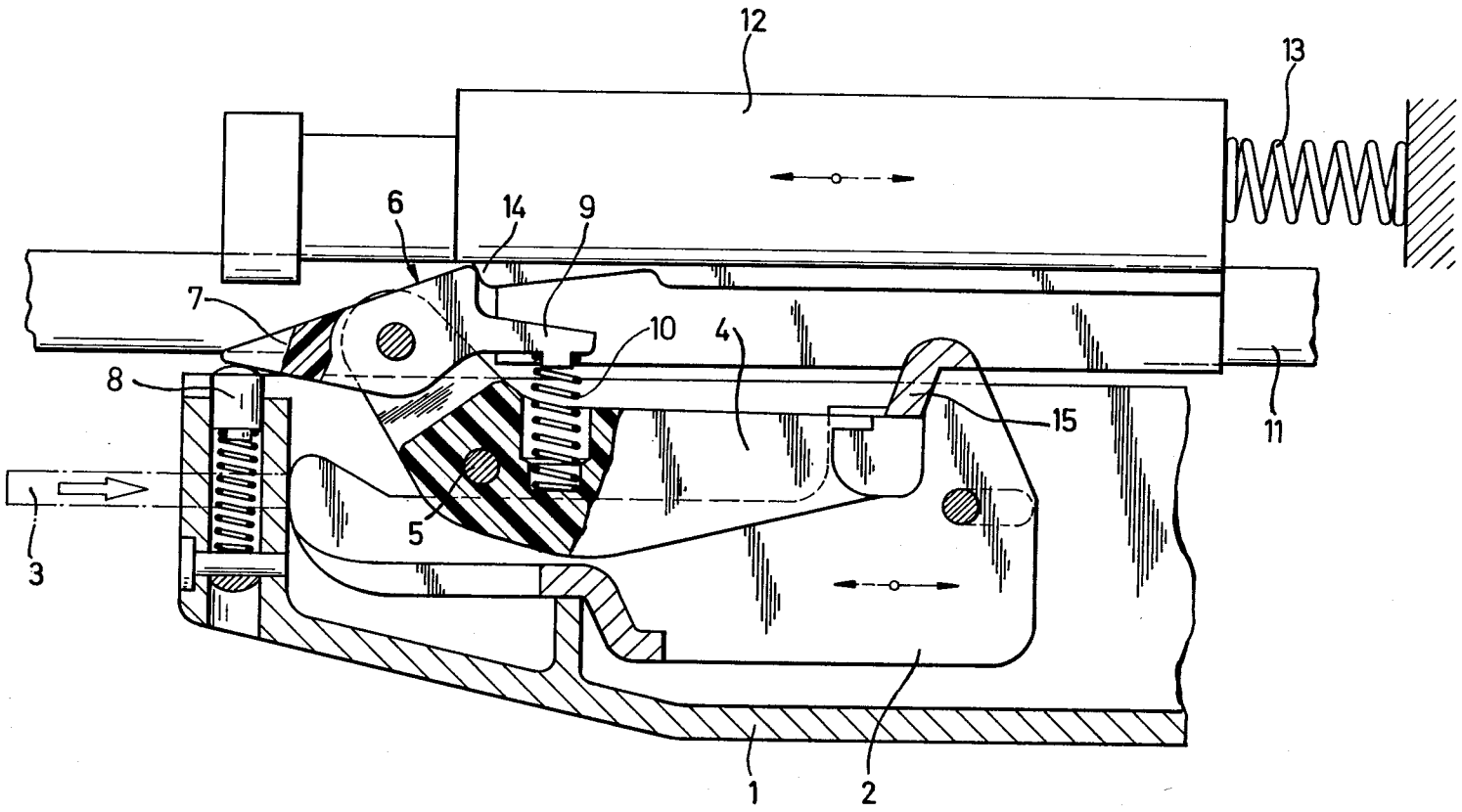
13
11
12
15
2
1
4
10
9
14
6
5
7
8
3

TRIGGER DEVICE FOR AUTOMATIC HANDGUNS

The invention concerns a trigger mechanism for automatic hand fire arms with a catching lever which arrests the lock, which returns after each firing of a shot against the bias of a spring, in its rearward position at a nose while the trigger is released.

Such hand fire arms have the advantage that the cartridge chamber of the barrel remains empty at any interruption of a sequence of shots, so that there is no cartridge present therein and there is thus no danger of a self-ignition of the cartridge due to overheating of the barrel after a preceding longer rate of firing. However, the catching lever is thereby subjected to a very high stress because it must suddenly arrest the lock which advances with a very high kinetic energy. This high stress may cause elastic deformations, not only of the catching lever, but also of the lock guiding parts; whereby the predetermined overlapping grip of the catching lever over the nose provided on the lock can be diminished to a degree such that the safety of arresting the forward-moving lock is no longer guaranteed. For these reasons, the catching lever and the other associated parts of the trigger mechanism and/or the lock guide are manufactured from highly resistant materials, in particular hardened steel, whereby, not only is the weight of the weapon increased, but the technical input for manufacturing these parts is raised.

Therefore, the invention is directed at the task of removing this drawback and to improve the initially described trigger mechanism, by simple means, in a manner such that no decrease in the overlapping grip of the catching lever and lock nose will occur, in spite of possibly occurring deformations, but that complete safety prevails and a favorable distribution of force is attained, so that the catching elements can even be produced from synthetic resin material.

The task is solved in accordance with the invention by that the catching lever bears at its forward end a catching pawl which is designed as a double-arm rocking lever whose forward lever arm is supported, against the force of the lock spring, on a spring-suspended abutment, with an expanding pressure spring being inserted between the rearward lever arm of this rocking lever and the catching lever.

When a sudden load occurs, the catching pawl carries out a rocking motion through the spring-suspended abutment in the positive direction of the lock spring, and therewith in a sense of augmenting the overlapping grip of the nose on the lock, so that the necessary overlapping grip will be preserved in spite of a possible elastic deformation of the catching lever, thus avoiding the danger of an unintentionally fired shot. In this case, the spring-suspended abutment acts, in a way, as a shock absorber while the lock is being arrested. The compression spring, which has been inserted between the rocking lever constituting the catching pawl and the catching lever, serves in effective combination with the resilient support on the abutment, as a return spring, in order to return the catching lever, after a shot has been fired, to its starting position, in which it is held by means of a slide member or the like which is connected with the trigger.

The drawing shows, in partial section and in simplified representation, an embodiment of the parts, being essential to the invention, of a trigger mechanism for an automatic rifle.

The trigger mechanism comprises a housing 1 in which there is supported for forward and rearward displacement a slide member 2 which is coupled via a trigger bar 3 with the trigger to be actuated by the marksman's finger. Furthermore, there is arranged in the housing 1 a catching lever 4, to be rockable about the shaft 5, which carries at its forward end a catching pawl 6. The catching pawl 6 is designed as a double-arm rocking lever, whose forward arm 7 is supported on a resilient abutment 8. Between the rearward lever arm 9 of the catching pawl 6 and the catching lever 4, there is inserted an expanding compression spring 10. There are designated by 11 longitudinal guide elements for the lock 12 which is biassed by a strong lock spring 13 and bears on its underside a nose 14 for cooperation with the catching pawl 6.

In the shown position the lock 12 is arrested by the catching pawl 6 against the force of the lock spring 13 while no cartridge is present in the cartridge chamber (not shown). The catching lever 4 is prevented by a leg 15, overlapping the same, of the slide member 2 from carrying out a rocking movement. When the trigger is actuated, i.e. when the slide member 2 is moved rearward via the trigger bar 2 then the rear end of the catching lever 4 is set free and can swivel upwardly under pressure of the lock spring acting on the catching pawl 6 by means of the nose 14, whereby the lock 12 can shoot forward, and in doing so pick up a cartridge from the magazine (likewise not shown) and insert it into the cartridge chamber whereupon a shot can be fired in the usual manner, and the lock 12 moves backward against the force of the lock spring 13. In doing so, the rearward part of the catching lever 4 is swivelled downwardly, with the aid of the expanding compression spring 10, in a manner such that, with the trigger being released, the leg 15 can again overlap this rearward end. When the lock 12 advances again, its nose 14 abuts against the catching pawl 6, while there results a certain counter-clockwise rocking motion of the catching pawl 6 owing to the resilient support of the lever arm 7 on the abutment 8, so that the overlapping grip of the catching pawl 6 over the nose 14 is increased rather than being decreased by an elastic deformation of the catching elements.

We claim:

1. A trigger mechanism for automatic hand firearms, comprising a lock including a nose, said lock being movable between a forward released position and a rearward arrested position, a lock spring biasing said lock towards said forward position, an actuable catching lever for arresting and releasing said lock, said catching lever being movable between an arrested and a released position, a catching pawl cooperating with said catching lever, said catching pawl being mounted for swiveling motion at a forward end of said catching lever to engage and disengage said nose, said catching pawl comprising a double-arm rocking lever having a forward lever arm and a rear lever arm, first spring means acting on said forward lever arm to urge said catching pawl into engagement with said nose and thereby to arrest said lock, and second spring means acting on said rear lever arm and said catching lever to urge said catching lever into its arrested position.

2. The trigger mechanism of claim 1, further comprising slide means, said slide means including means to engage said catching lever, and retain said catching lever in its arrested position.

3. The trigger mechanism of claim 1, wherein said catching lever is made from a synthetic resin material.

* * * * *